United States Patent [19]

Lo et al.

[11] Patent Number: 4,528,790

[45] Date of Patent: Jul. 16, 1985

[54] ROOF INSULATION SYSTEM

[75] Inventors: Shao-Kuei Lo, Heath; Steven D. Crothers, Newark, both of Ohio

[73] Assignee: Owens-Corning Fiberglas Corporation, Toledo, Ohio

[21] Appl. No.: 513,495

[22] Filed: Jul. 13, 1983

[51] Int. Cl.[3] ..... E04B 2/00

[52] U.S. Cl. ..... 52/407; 52/484; 52/486

[58] Field of Search ..... 52/404, 90, 484, 486, 52/407

[56] References Cited

U.S. PATENT DOCUMENTS 3,791,089 2/1974 Alderman ..... 52/484

4,391,075 7/1983 Musgrave ..... 52/486 X

*Primary Examiner*—Carl D. Friedman

*Attorney, Agent, or Firm*—Ronald C. Hudgens; Ted C. Gillespie; Paul J. Rose

[57] ABSTRACT

Insulation supporting tubes are suspended from auxiliary support beams extending transversely of and supported by more widely spaced main support beams. The insulation supporting tubes extend all the way across a bay between adjacent main support beams and are supported by two hangers at opposite ends and by a circular hook at midlength. For clamping at eave struts, a hanger assembly is mounted on each eave strut between each two adjacent insulation strips, the hanger assembly including two independently vertically adjustable axle tubes received respectively in adjacent bushings of two adjacent clamping tubes.

8 Claims, 16 Drawing Figures

ROOF INSULATION SYSTEM

TECHNICAL FIELD

This invention relates to roof insulation systems for metal buildings, also known in the art as pre-engineered buildings.

BACKGROUND ART

U.S. Pat. No. 4,391,075 discloses an insulated roof structure wherein hangers are installed on the purlins for supporting rollers over which strips of faced glass fiber insulation are strung. Each hanger supports an axle tube and each roller includes a tubular body with bushings pressed respectively into opposite ends. The rollers have essentially the same length as the width of one of the insulation strips. Typically this is either four feet or six feet. Further, each roller has a hanger and axle tube at each end. Thus, in a typical bay between main girders, each purlin has either seven hangers supporting six four-foot rollers or five hangers supporting four six-foot rollers. At the eave struts, rollers are used to clamp the ends of the insulation strips. This has resulted in some difficulties, because raising the axle tube on one hanger raises the adjacent ends of two rollers. One of these is being moved into clamping position on a strip of insulation, but because the other is also being raised, it makes it more difficult to feed the next strip of insulation thereover.

DISCLOSURE OF INVENTION

In accordance with the invention, insulation supporting tubes are joined together by tightly fitting internal sleeves, whereby such a composite tube extends substantially all the way across a bay between main girders. Bushings are inserted at the opposite ends of the composite tube and only two hangers with axle tubes are used for the composite tube extending across the bay. At the midlength of the composite tube, an additional hanger is provided, this additional hanger not having an axle tube for bushings, but rather having at it lower end a generally circular hook for encircling and supporting the composite tube at midlength. The number of hangers with axle tubes is thus reduced and there is greater freedom for stringing the insulation strips. Further, in many cases the composite tubes can be omitted on every other purlin. At the eave struts, a hanger assembly with two independently movable axle tubes is provided at each insulation joint, whereby one clamping tube can be raised for clamping the end of an insulation strip while an adjacent clamping tube can be maintained in its lowest position for each in stringing the next insulation strip thereover.

BRIEF DESCRIPTION OF DRAWINGS

The invention is explained more fully hereinafter with reference to the accompanying drawings in which.

BEST MODE OF CARRYING OUT THE INVENTION

Figure 1:
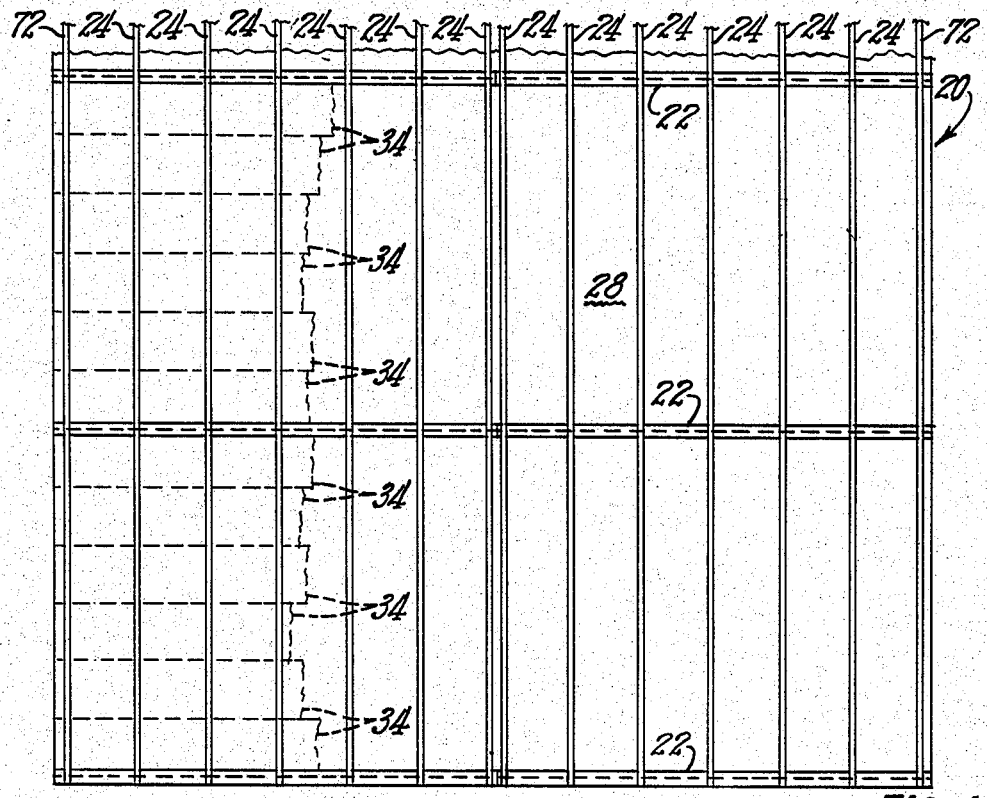
FIG. 1 is a fragmentary plan view of a portion of a building to be insulated in accordance with the invention.
Figure 2:
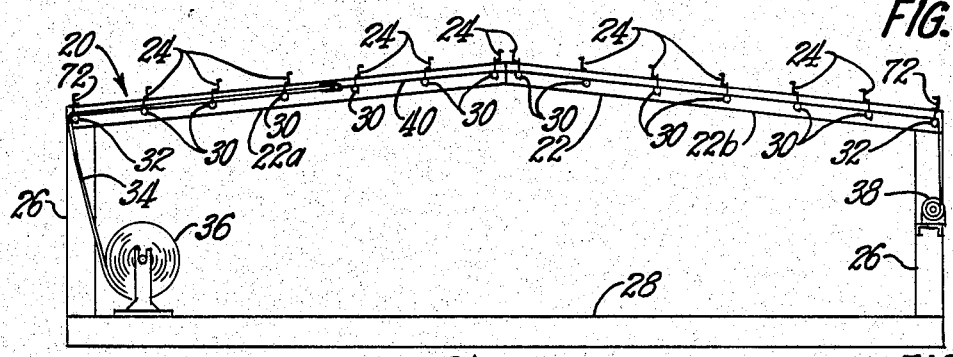
FIG. 2 is an end elevational view indicating composite insulation supporting tubes on every purlin, and insulation being strung thereover.

With reference to the drawings, FIGS. 1 and 2 show a portion of a building 20 suitable for the roof insulation system of my invention. The building 20 comprises a plurality of parallel, spaced main support beeams or girders 22 and a plurality of parallel, horizontally extending auxiliary support beams or purlins 24 spaced from each other and supported by and extending transversely of the main support beams or girders 22. Each girder 22 includes a pair of I-beams **22*a* and 22*b* extending angularly upwardly toward each other respectively form a pair of side support posts 26 resting on a floor slab 28**.

Figure 13:
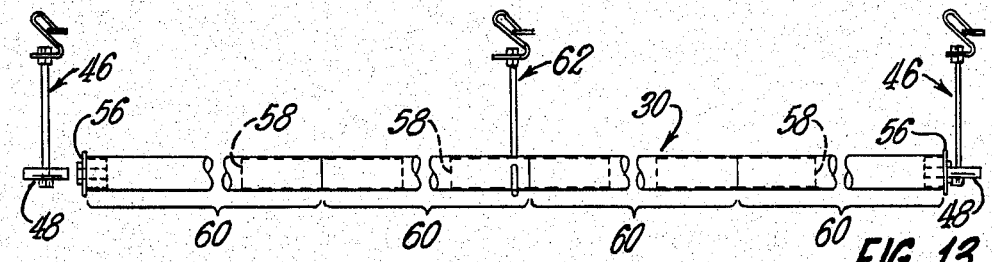
FIG. 13 is a fragmentary elevational view of a composite tube with two hangers disposed respectively at opposite ends and having axle tubes, and a midlength hanger having a generally circular hook encircling the composite tube.

In the bay between each pair of adjacent girders 22, the building 20 has a composite insulation supporting tube 30, such as shown in FIG. 13, hung on each of the purlins 24. As explained later with reference to FIGS. 14 and 15, at an eave strut 72 on each side of the building there is a series of clamping tubes 32. In broken lines, FIG. 1 fragmentarily shows six strips 34 of faced glass wool insulation in each of two bays respectively between pairs of adjacent girders 22. Typically, the strips 34 are four feet wide. Alternatively, there could be four strips 34, each six feet wide, in each bay. The insulation strips 34 are strung one at a time across the composite tubes 30 from a supply roll 36. A winch 38 is used to pull a cable 40 clamped to the leading edge of an insulating strip 34.

Figure 3:
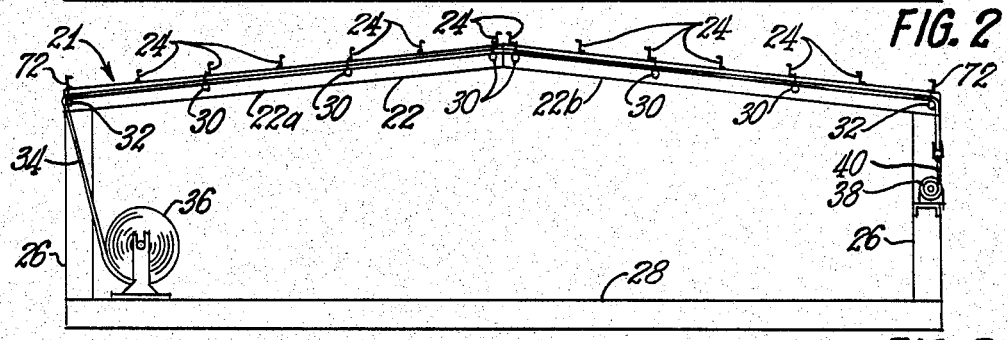
FIG. 3 is a view similar to FIG. 2, but indicating the composite tubes on only every other purlin.

FIG. 3 shows a building 21 wherein the composite tubes 30 are omitted on every other purlin 24.

Figure 4:
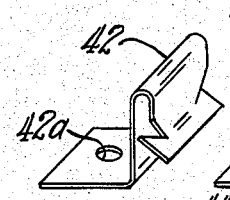
FIG. 4 is a perspective view of a hanger clip for use with purlins or other structural members having a vertically upwardly extending lower flange.

FIG. 4 shows a mounting clip 42 for a hanger assembly, the clips 42 being for purlins 34 or other structural members having a generally vertical lower upstanding flange.

Figure 5:
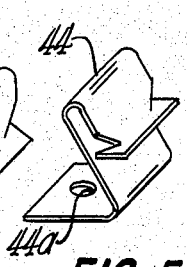
FIG. 5 is a perspective view of a hanger clip for use with purlins having an angularly upwardly extending lower flange substantially at forty-five degrees to a vertical plane.
Figure 7:
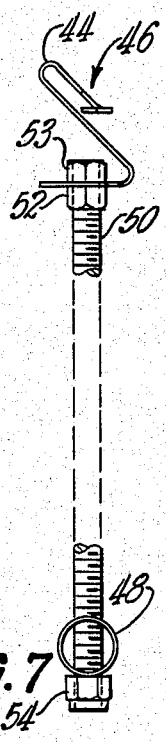
FIG. 7 is an elevational view of a hanger assembly for a composite insulation supporting tube.

FIG. 5 shows a mounting clip 44 for a hanger assembly 46 shown in FIG. 7. The clip 44 is for purlins 34 having an angularly upwardly extending lower flange substantially at forty-five degrees to a vertical plane.

Figure 6:
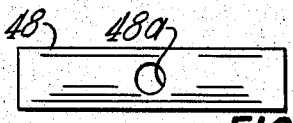
FIG. 6 is a plan view of an axle tube of a hanger assembly for a composite tube.

FIG. 6 shows an axle tube 48 for one of the hanger assemblies 46. Each hanger assembly 46 includes a mounting clip 44, a threaded rod 50, a pair of nuts 52 and 53 securing the clip 44 to the rod, an axle tube 48, and a self-locking nut 54. The clips 42 and 44 and axle tubes 48 respectively have holes 42*a*, 44*a*, and 48*a* for receiving rods 50.

Figure 11:
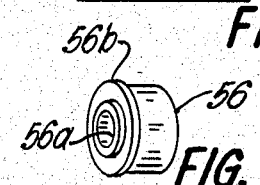
FIG. 11 is a perspective view of a bushing for a composite tube or for a clamping tube.
Figure 12:
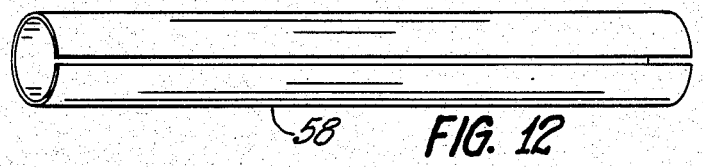
FIG. 12 is a perspective view of an internal sleeve for a comparative tube.
Figure 16:
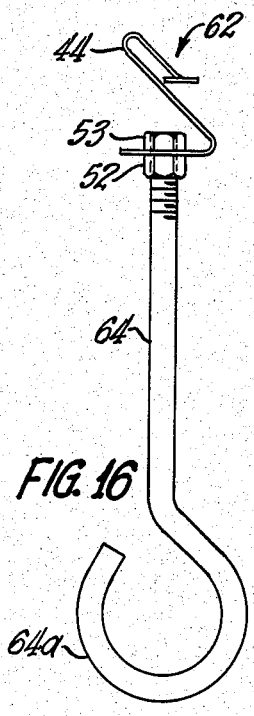
FIG. 16 is an elevational view of a midlength hanger for a composite tube such as shown in FIG. 13.

FIG. 11 shows a bushing 56 preferably of molded plastic and having a center hole 56*a* for receiving an axle tube 48 and a flange 56*b* as a stop collar for the composite tube 30. FIG. 12 shows an internal connecting sleeve 58. The extended or composite tube 30 of FIG. 13 includes four tubes 60 axially connected by three of the sleeves 58 and having a pair of the bushings 56 respectively in opposite end portions of the four-tube unit. Alternatively, the composite tube 30 can be a single long tube, but the use of shorter tubes assembled at the job site with connecting sleeves 58 is more convenient for shipping and storage. Axle tubes 48 of two hanger assemblies 46 are inserted respectively in the bushings 56. Each tube 60 may be the same as a clamping tube 32. A midlength hanger 62 for the composite tube 30 prevents sagging of the tube 30 in the middle. As best shown in FIG. 16, the hanger 62 includes a mounting clip 44 and a pair of nuts 52 and 53 securing the clip to a threaded rod 64 having a generally circular hook 64*a* at its lower end for encircling the tube 30.

Figure 8:
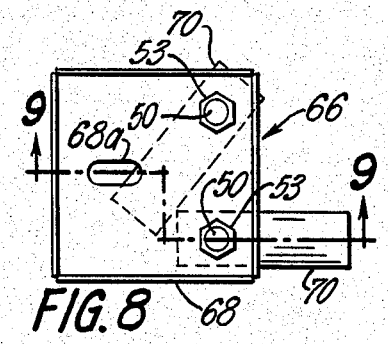
FIG. 8 is a plan view of a hanger assembly with two independently movable axle tubes for use with two adjacent clamping tubes in clamping the ends of two adjacent insulation strips at an eave strut.
Figure 9:
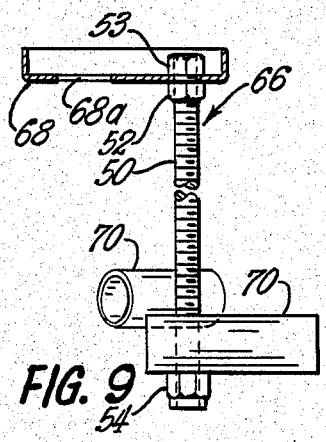
FIG. 9 is an elevational view of the assembly of FIG. 8, partly in section taken generally along the line 9—9.
Figure 10:
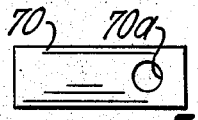
FIG. 10 is a plan view of one of the short axle tubes of the assembly of FIGS. 8 and 9.

FIGS. 8 and 9 show a hanger assembly 66 for a pair of the clamping tubes 32. The hanger 66 includes a substantially square, flanged mounting plate 68 having a hole 68*a* for receiving a mounting bolt. Two of the threaded rods 50 are secured to the mounting plate 68, each by a pair of nuts 52 and 53. Each rod 50 has an axle tube 70 eccentrically mounted loosely thereon by a self-locking nut 54. An axle tube 70 is shown separately in FIG. 10. Each axle tube 70 has an off-center hole 70*a* therethrough for receiving a rod 50 and is adapted to be received at its longer end portion in one of the bushings 56.

Figure 14:
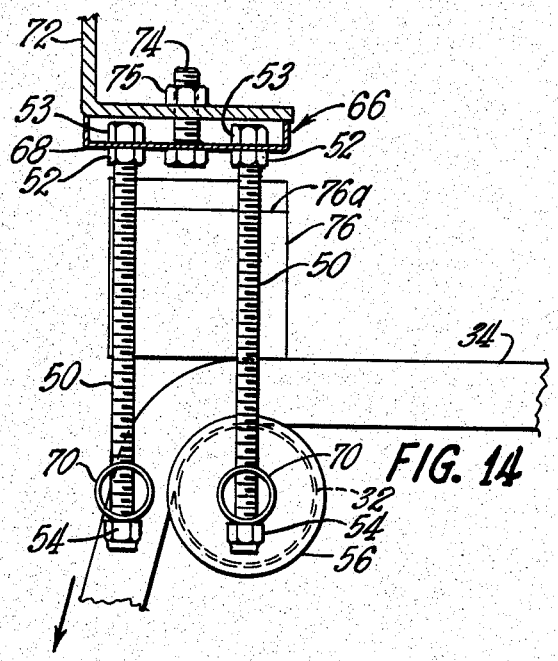
FIGS. 14 and 15 are elevational views, partly in section, illustrating the use of the assembly of FIGS. 8 and 9 in the clamping of an insulating strip at an eave strut.
Figure 15:
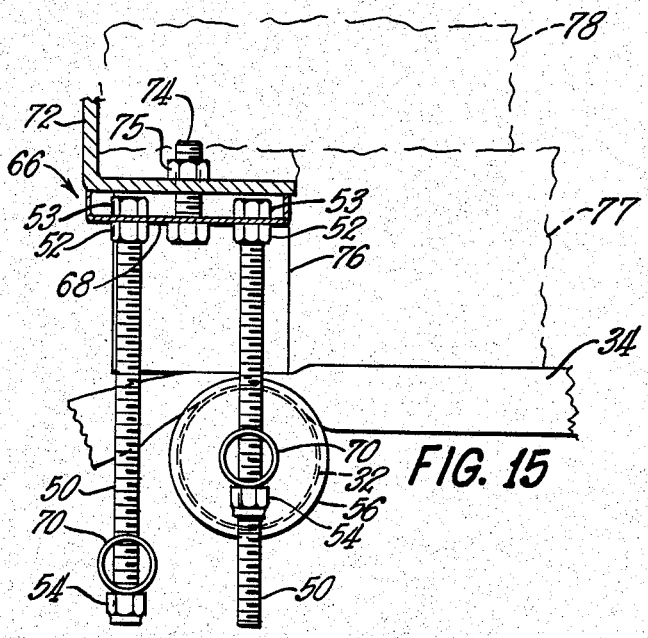

FIGS. 14 and 15 show one of the hanger assemblies 66 is use. The mounting plate 68 is clamped to the respective eave strut 72 by a bolt 74 and nut 75. A clamping tube 32 with bushings 56 therein at opposite ends is mounted at its near end on the axle tube 70 of the right-hand rod 50 as viewed in FIGS. 14 and 15. It will be understood that the far end of the clamping tube 32 is similarly supported on another hanger assembly 66 directly aligned with the one shown but located behind the plane of the paper. After the insulating strip 34 has been drawn over the clamping tube 32 and pulled taut, a clamping bar 76 is manually positioned longitudinally between the hanger assemblies 66 and transversely between the eave strut 72 and the clamping tube 32 but above the insulating strip 34. The respective self-locking nuts 54 of the two hanger assemblies 66 are then tightened up to clamp the insulation strip 34, as shown in FIG. 15. The clamping bar 76 is preferably made of rigid foamed plastic and opposite ends thereof are kerfed as at 76*a* to allow for the mounting plates 68. Additional blankets 77 and 78 of unfaced glass fiber insulation may then be placed over the insulation strip 34, as shown in broken lines in FIG. 15, and covered with roofing panels (not shown).

The next insulation strip 34 to be strung over the composite tubes 30 is clamped by another clamping tube 32 placed on the axle tube 70 of the left-hand rod 50 as viewed in FIGS. 14 and 15 and extending out of the plane of the paper toward the viewer. Thus, each clamping tube 32 is operable independently of the position of the other of a pair of adjacent clamping tubes.

Various modifications may be made in the structure shown and described without departing from the spirit and scope of the invention.

We claim:

1. A roof insulation system for a building having a framework of parallel, relatively widely spaced main support beams and parallel, relatively narrowly spaced auxiliary support beams supported by and extending perpendicularly to the main support beams, each pair of adjacent main support beams partially defining a bay, said roof insulation system comprising insulation supporting tubes suspended respectively from at least some of the auxiliary support beams in each bay, the insulation supporting tubes extending substantially all the way across the bay and being parallel to the auxiliary support beams, each insulation supporting tube being suspended solely by three hangers, namely, a pair of end hangers disposed respectively adjacent opposite end portions of the tube and attached to a respective one of the auxiliary support beams and a midlength hanger disposed substantially at the midlength of the tube, attached to the respective one of the auxiliary support beams, and having a hook portion partially surrounding the tube, and a plurality of contiguous strips of faced fibrous insulation strung across the insulation supporting tubes, said faced fibrous insulation strips having no other supporting means therebeneath between pairs of adjacent insulation supporting tubes or between the pair of adjacent main support beams defining the bay.

2. A roof insulation system as claimed in claim 1 wherein the insulation supporting tubes are suspended respectively from all of the auxiliary support beams in each bay.

3. A roof insulation system as claimed in claim 1 wherein the insulation supporting tubes are suspended respectively only from alternate ones of the auxiliary support beams in each bay.

4. A roof insulation system as claimed in claim 1 wherein each insulation supporting tube has a pair of bushings disposed respectively in opposite end portions thereof and each end hanger includes an axle tube disposed in a respective one of the bushings.

5. A roof insulation system as claimed in claim 1 wherein each insulation supporting tube is a complete tube of a plurality of shorter tubes axially joined in series by internal connecting sleeves respectively disposed at each joint.

6. A roof insulation system as claimed in claim 1 wherein the insulation is fibrous glass.

7. A roof insulation system as claimed in claim 1 wherein the building framework also includes eave struts parallel to the auxiliary support means and disposed respectively adjacent outer end portions of the main support beams, and clamping means forming permanent parts of the system are provided to clamp opposite end portions of each insulation strip respectively to the eave struts independently of the clamping of any insulation strips adjacent thereto.

8. A roof insulation system as claimed in claim 7 wherein the clamping means for each end portion of an insulation strip includes a clamping tube having bushings disposed respectively in opposite end portions thereof, and a pair of hanger assemblies mounted on the respective eave strut respectively adjacent the opposite end portions of the clamping tube, each of the hanger assemblies including two axle tubes adjustable vertically independently of each other, one of which is received in the respective bushing of the clamping tube and the other of which is received in a respective one of the bushings of an adjacent clamping tube when there is an adjacent insulation strip in the bay.

* * * * *

UNITED STATES PATENT AND TRADEMARK OFFICE

CERTIFICATE OF CORRECTION

PATENT NO. : 4,528,790

DATED : July 16, 1985

INVENTOR(S) : Shao-Kuei Lo & Steven D. Crothers

It is certified that error appears in the above-identified patent and that said Letters Patent is hereby corrected as shown below:

At Column 4, line 54, the word "complete" should be changed to "composite".

At Column 4, line 62, the word "means" should be changed to "beams".

Signed and Sealed this

*Tenth* Day of *June 1986*

[SEAL]

*Attest:*

DONALD J. QUIGG

*Attesting Officer*

*Commissioner of Patents and Trademarks*